US012366064B2

(12) United States Patent
Yin et al.

(10) Patent No.: US 12,366,064 B2
(45) Date of Patent: Jul. 22, 2025

(54) TIE SHEAR CONNECTOR FOR WALL PANEL CONSTRUCTION AND METHOD THEREOF

(71) Applicants: Hongxi Yin, West Lafayette, IN (US); Ming Qu, West Lafayette, IN (US)

(72) Inventors: Hongxi Yin, West Lafayette, IN (US); Ming Qu, West Lafayette, IN (US)

( * ) Notice: Subject to any disclaimer, the term of this patent is extended or adjusted under 35 U.S.C. 154(b) by 178 days.

(21) Appl. No.: 16/483,803

(22) PCT Filed: Feb. 6, 2018

(86) PCT No.: PCT/US2018/016960
§ 371 (c)(1),
(2) Date: Aug. 6, 2019

(87) PCT Pub. No.: WO2018/145053
PCT Pub. Date: Aug. 9, 2018

(65) Prior Publication Data

US 2019/0352901 A1 Nov. 21, 2019

Related U.S. Application Data

(60) Provisional application No. 62/455,201, filed on Feb. 6, 2017.

(51) Int. Cl.
*E04B 1/48* (2006.01)
*E04C 2/288* (2006.01)

(52) U.S. Cl.
CPC ..... *E04B 1/483* (2013.01); *E04C 2/288* (2013.01)

(58) Field of Classification Search
CPC ..... E04B 1/483; E04C 2/288
USPC ..... 52/794.1
See application file for complete search history.

(56) References Cited

U.S. PATENT DOCUMENTS 1,832,231 A * 11/1931 Menninger ..... E04F 13/045 52/378
1,934,134 A * 11/1933 McChesney ..... E04B 1/49 411/478
2,046,338 A * 7/1936 McChesney ..... E04B 1/49 411/465
2,046,339 A * 7/1936 McChesney ..... E04B 1/49 411/464
3,757,482 A * 9/1973 Haeussler ..... E04C 2/044 52/378
3,996,713 A * 12/1976 Haeussler ..... E04C 5/163 52/378
D245,574 S * 8/1977 Courtois ..... D8/385
4,394,201 A * 7/1983 Haeussler ..... E04C 2/044 428/371
4,624,089 A * 11/1986 Dunker ..... E04C 2/06 52/712

(Continued)

*Primary Examiner* — Paola Agudelo
(74) *Attorney, Agent, or Firm* — Tyler B. Droste; Gutwein Law

(57) ABSTRACT

A tie shear connector for use with insulating composite panel structures having a first structure layer and second structure layer, comprising an elongated body having an interior cavity passage formed therethrough from at least one end, and at least one aperture configured to enable the flow of a fluidic hardenable material into a portion of the interior cavity passage. The tie shear connector can also comprise at least on placement pin to aid in depth penetration of the tie shear connector.

5 Claims, 17 Drawing Sheets

(56) References Cited

U.S. PATENT DOCUMENTS

| | | | | | |
|---|---|---|---|---|---|
| 4,974,381 | A * | 12/1990 | Marks | E04C 2/2885 | 52/410 |
| 5,809,723 | A * | 9/1998 | Keith | F16B 15/0015 | 411/475 |
| 6,138,981 | A * | 10/2000 | Keith | E04G 11/18 | 249/19 |
| D605,499 | S * | 12/2009 | Gaudron | D8/349 | |
| 9,303,404 | B2 * | 4/2016 | Naito | E04C 2/46 | |
| 9,611,651 | B2 * | 4/2017 | Eisenkrein | E04F 13/045 | |
| 10,011,988 | B2 * | 7/2018 | Foderberg | E04C 2/46 | |
| 10,711,423 | B2 * | 7/2020 | Hu | E02D 17/04 | |
| 2004/0118067 | A1 * | 6/2004 | Keith | B28B 19/003 | 52/415 |
| 2006/0137286 | A1 * | 6/2006 | Zartman | E04B 1/483 | 52/698 |
| 2014/0087158 | A1 * | 3/2014 | Ciuperca | B32B 3/266 | 428/223 |
| 2017/0058520 | A1 * | 3/2017 | Keith | E04C 2/044 | |
| 2020/0263416 | A1 * | 8/2020 | Walsh | E04C 2/288 | |
| 2021/0301527 | A1 * | 9/2021 | Dombowsky | B28B 19/0015 | |
| 2021/0363753 | A1 * | 11/2021 | Valente | B32B 7/05 | |

* cited by examiner

TIE SHEAR CONNECTOR FOR WALL PANEL CONSTRUCTION AND METHOD THEREOF

CROSS REFERENCE TO RELATED APPLICATIONS

This application claims priority to U.S. Provisional Patent Application No. 62/455,201 filed 6 Feb. 2017, to the listed inventors, and is herein incorporated by reference in its entirety.

FIELD OF THE INVENTION

This invention generally relates to a connector for insulating composite panel structures. In one respect, the connector is a tubular or a partially closed-tubular tie connector made with material having high strength, high thermal resistance (R-value), and low thermal conductivity to effectively secure adjacent panels and prevent thermal loss through the connecting components in the composite panel structures.

BACKGROUND

Generally, an insulating panel structure includes a rigid insulation layer interposed between a first hardenable structure layer and a second structure layer. Insulated concrete panels or sometimes called insulated double wall panels are well known in the construction industry. Such concrete panels or wythes are generally formed with insulation layers sandwiched between a pair of concrete layers. To secure the concrete layers to the insulation layers, connectors or ties are typically used. These ties connect the two concrete layers together through the insulation layer, wherein the ties protrude through the insulation layer sides and into the pair of concrete layers. As such, the ties hold the components of the insulated concrete panels together and also provide a mechanism whereby loads can be transferred between the concrete layers.

The insulating panel structure has all the desired characteristics of a normal concrete panel such as durability and fire resistance, but also provides superior energy performance and moisture protection. The ties or connectors are provided for extending through the insulation layer and into the two structure layers to consolidate them together and transfer the forces between the two structure layers. There are some kinds of the connectors made by high thermal conductive materials like metal. These metal connectors act like a bridge for heat from a warm space to easily transfer across the insulating panel structure to a cold space, thereby causing thermal loss. Such connectors may be found in the following U.S. patents: U.S. Pat. Nos. 4,393,635, 4,329,821, 2,775,018, 2,645,929, and 2,412,744.

In order to address the challenge of the thermal bridging, some new materials and compositions have been developed using high R-value materials as shown in U.S. patents: U.S. Pat. Nos. 4,829,733; 5,673,525; 6,116,836; 6,761,007; 8,365,501. All the connectors, however, were designed only for concrete sandwich panels and may not provide adequate strength and support if they are not densely installed. Current connectors for tie connectors for concrete sandwiches typically are made of wire or polymers which have a low bending stiffness and can only transfer a small shear between the concrete layers.

Therefore, there exists a need for an improved and versatile connector for use in various insulating panel structures with different configurations of the structural panels, wherein the structural panels include hardenable material structures, steel structures, wood structures, and others. A further objective of the present invention is to provide an improved connector with greater strength and energy performance, while simplifying and driving construction efficiency and use.

Additionally, the present invention provides a tie shear connector having increased strength to enable tension and compression forces at the extreme ends of the tie shear connector, which are necessary for shear transfer through the connector. Similarly, the symmetry of the design and construction of the tie shear connector can enable the production and construction of tie shear connectors on a large scale.

BRIEF SUMMARY OF THE INVENTION

In one aspect, this disclosure is related to a tie shear connector for use with insulating composite panel structures having a first structure layer and second structure layer, the tie shear connector comprising an elongated body having an exterior wall, an interior wall, a first end, and second end, wherein said elongated body forms an interior cavity passage formed therethrough from said first end to said second end, and at least one aperture configured to enable the flow of a fluidic hardenable material into a portion of said passage.

Another aspect of the invention relates to a method of constructing insulating composite wall structures comprising providing an insulation layer panel wherein said insulation layer has first surface and a second surface. At least one tie shear connector can be inserted into said insulation layer, wherein said tie shear connector comprises an elongated body with a cavity running therethrough. The tie shear connector can have at least one aperture configured to provide access into the cavity. A first structure layer can be poured using a first hardenable material. The insulation layer can be placed on the first structure layer of hardenable material prior to the hardenable material hardening, such that the first surface of the insulation layer is in contact with the first layer of the hardenable material, wherein a portion of the tie shear connector is embedded in the first hardenable material and said hardenable material enters a portion of the cavity through the aperture. A second structure layer can be poured using a second hardenable material over the second surface of the insulation layer, such that the second surface of the insulation layer is in contact with the second layer of the hardenable material, wherein a portion of the tie shear connector is embedded in the second hardenable material and said hardenable material enters a portion of the cavity through the aperture. The tie shear connector and said cavity of said tie shear connector is configured to transfer shear forces and resist delamination forces between said first and second layers of hardenable material.

Another aspect of this disclosure relates to an insulated composite wall structure comprising a first structure layer, a second structure layer, an insulation layer having a first surface and a second surface located between the first and second structure layer, and at least one tie shear connector configured to couple said insulation layer, first structure layer, and second structure layer.

Another aspect the invention relates to a method of constructing insulating composite wall structures comprising providing an insulation layer panel wherein said insulation layer has first surface and a second surface. At least one tie shear connector can be inserted into said insulation layer, wherein said tie shear connector comprises an elongated body with a cavity running therethrough. The tie shear connector can have at least one aperture configured to provide access into the cavity. A first structure layer can be poured using a first hardenable material. The insulation layer can be placed on the first structure layer of hardenable material prior to the hardenable material hardening, such that the first surface of the insulation layer is in contact with the first layer of the hardenable material, wherein a portion of the tie shear connector is embedded in the first hardenable material and said hardenable material enters a portion of the cavity through the aperture. A second structure layer can be coupled to the tie shear using a coupling mechanism where the second structure is comprised from a more rigid material, such as a metal or wood. The second structure can be in contact with the second surface of the insulation, wherein a portion of the tie shear connector is embedded within or coupled to the second structure. The tie shear connector is configured to transfer shear forces and resist delamination forces between said first and second layers of material.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
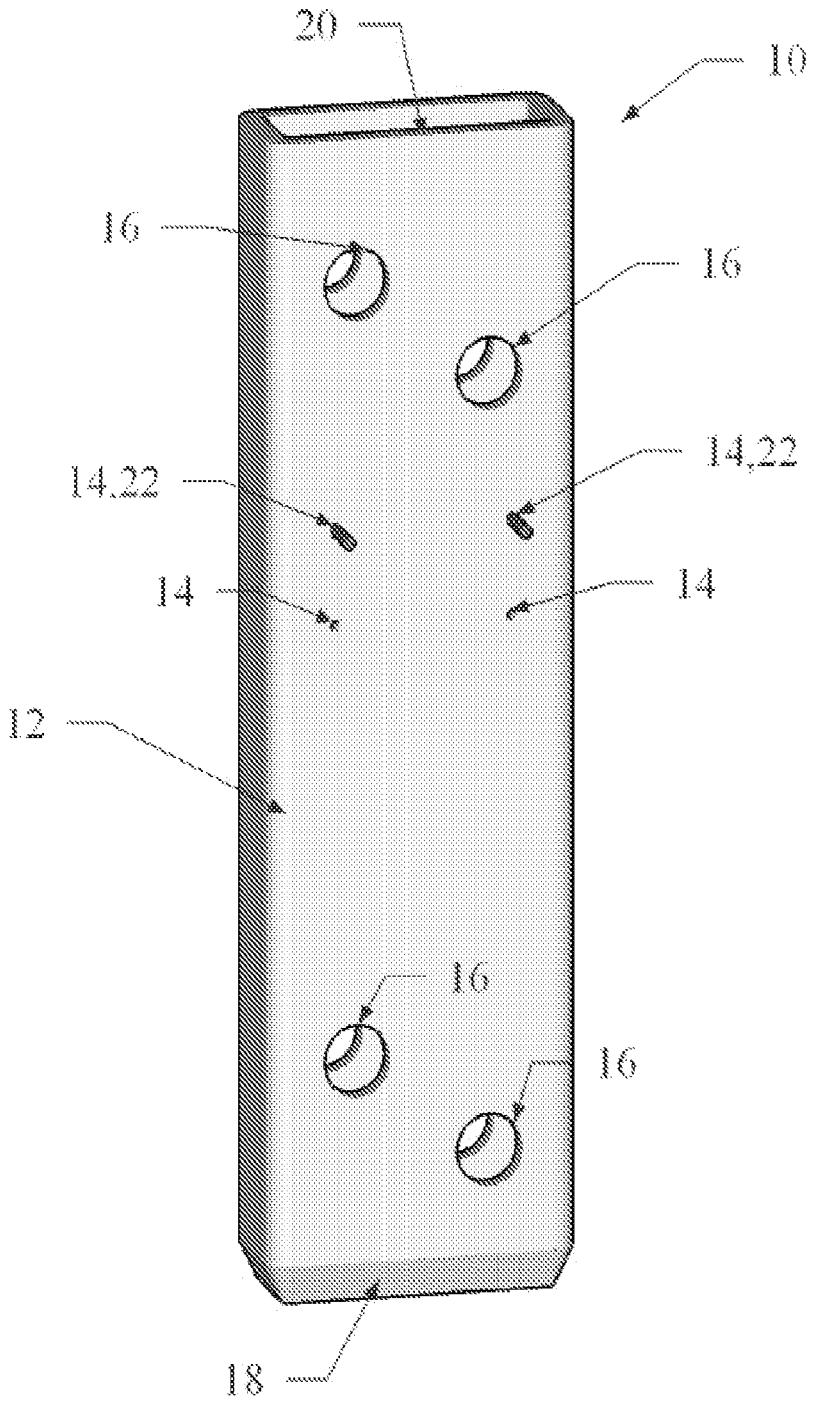
FIG. 1 is a perspective view of an exemplary embodiment of a tubular tie connector of the present invention having a blade end at the penetrating segment.
Figure 2:
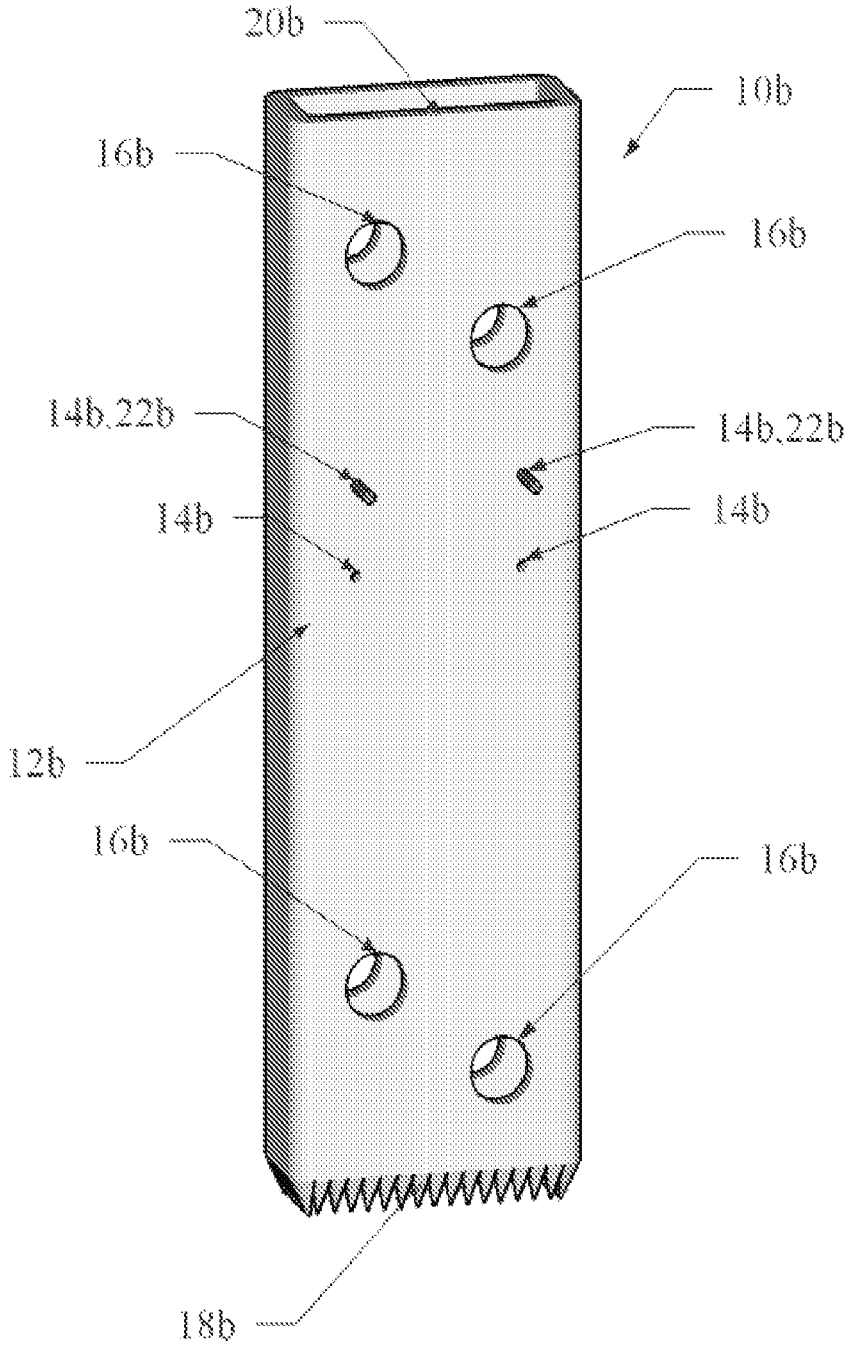
FIG. 2 is a perspective view of another exemplary embodiment of a tubular tie connector of the present invention with a saw-tooth end at a penetrating segment.
Figure 3:
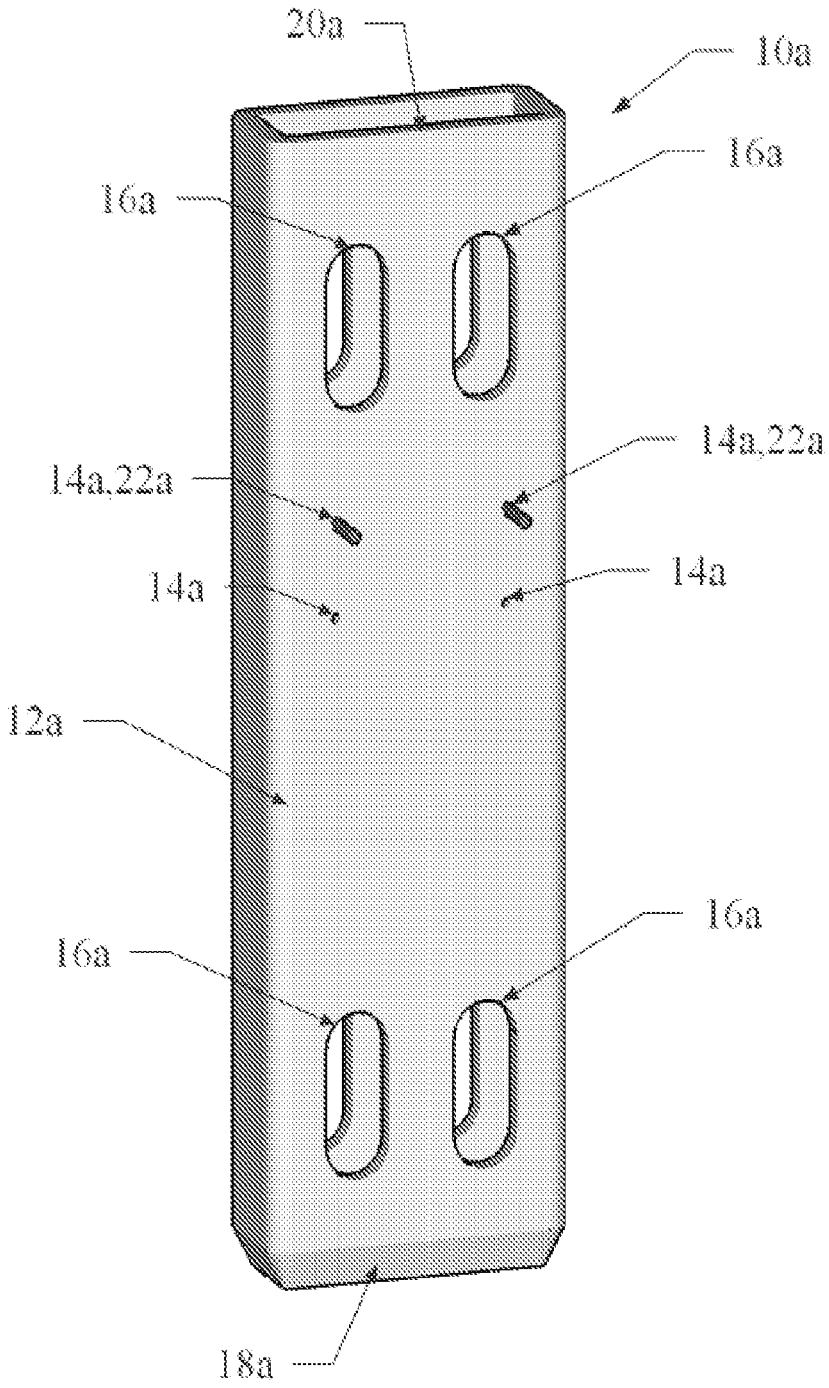
FIG. 3 is a perspective view of an exemplary embodiment of the tubular tie connector of the present invention with larger apertures on the penetrating and balance segment.
Figure 4:
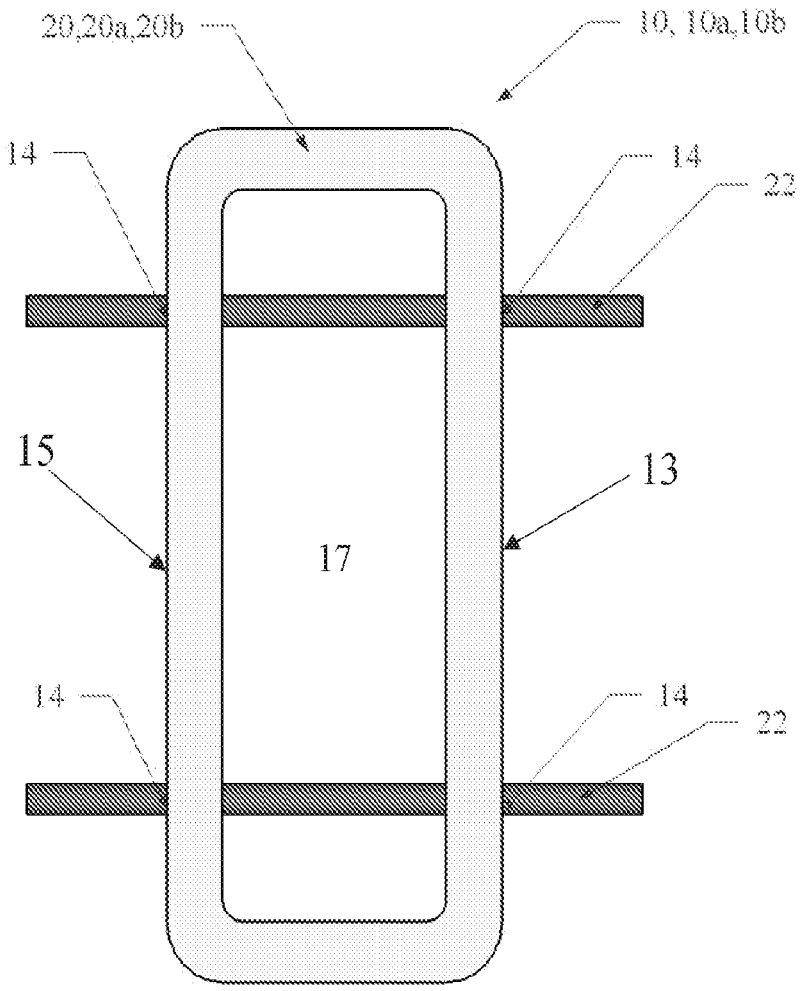
FIG. 4 is a top view of is a sectional view taken from the top of the tie shear connector illustrated in FIG. 1 installed in an insulated panel structure.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful, and is not intended to exclude other embodiments from the scope of the invention.

As used herein, the term "coupled" means the joining of two members directly or indirectly to one another. Such joining may be stationary in nature or movable in nature and/or such joining may allow for the flow of fluids. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 5:
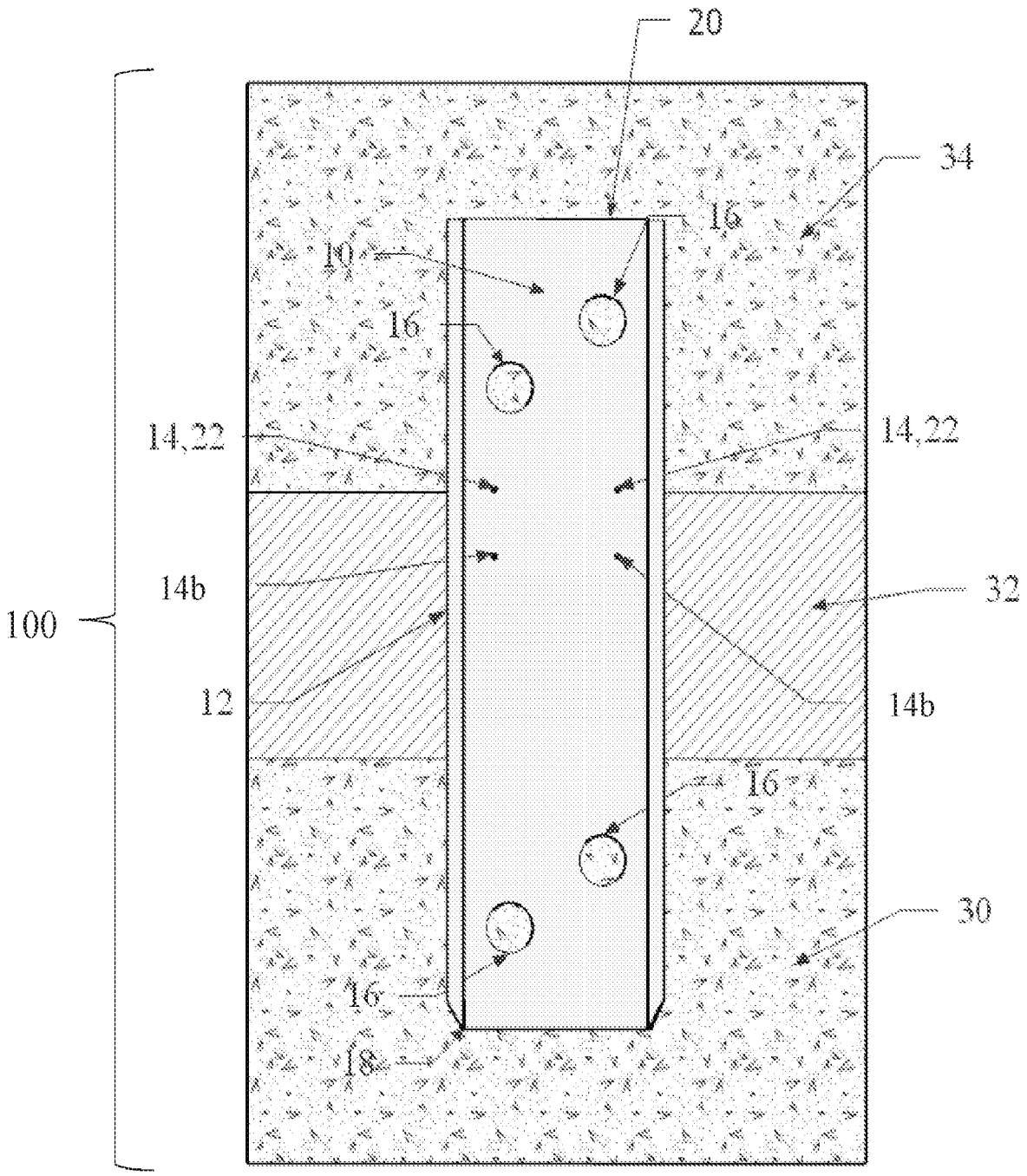
FIG. 5 is a side view taken along the inner surface along a length direction of the tie shear connector illustrated in FIG. 1 installed in an insulated panel structure.

In one exemplary embodiment of the tie shear connector 10 of the present invention in FIGS. 1-11, the tie shear connector 10 is generally provided with a tubular body. Accordingly, the tubular tie shear connector 10 can have a hollow rounded rectangular shape. The tie shear connector 10 is designed for connecting an insulating composite panel structure 100, as shown in FIG. 5. The insulating composite panel structure 100 consists of a first structural layer 30 and a second structural layer 34 and an insulation layer 32 interposed between the two structural layers 30, 34. The first structural layer 30 can be made using a hardenable material, such as a concrete, composites, polymers, epoxies, or other similar materials, and the second structural layer 34 can be made from a hardenable material, such as a concrete, composites, polymers, epoxies, or other material, such as metal, wood, or other similar materials. The insulation layer 32 can be a rigid polystyrene foam plastic insulation used in typical construction. Alternately, the insulation layer 32 can be other suitable insulation material offering similar properties to polystyrene foam.

The tie shear connector 10 can be made using any suitable materials, such as high R-value materials including fibers, composite fibers, fiber-reinforced polymer such as carbon-fiber-reinforced polymer, glass-fiber-reinforced polymer, and basalt-fiber-reinforced polymer, so that the thermal losses through the connectors can be eliminated or significantly reduced. Polymers or reinforced fiber polymers constructed using thermoset resin such as polyester, vinyl ester, epoxy, and phenolics. Alternatively, the tie shear connector 10 can be made of other materials or other composite material having a high R-value. The tie shear connector 10 includes an elongated body 12. In one exemplary embodiment of the present invention, the elongated body 12 can have three segments: a penetrating segment 5, a balance segment 7, and a mesial segment 9 best show in FIG. 6A. The three segments 5, 7, 9 of the elongated body 12 are preferably formed in a one-piece construction and can take various shapes, including but not limited to, a hollow rounded rectangle, hollow circle, hollow ellipse, and other hollow shapes.

The elongated body 12 is tubular in nature in that it has a wall forming a cavity within the wall as shown in FIGS. 1-11. The cavity can extend throughout the entire elongated body 12 or a portion of the elongated body 12. The elongated body 12 can be opened at either end. In one exemplary embodiment, the elongated body 12 is open on both ends forming a passage 17 through the entire elongated body 12. The penetrating segment 5 can have a blade end 18 designated for protruding the tie shear connector 10 through the insulation layer 32 and entering into the first structure layer 30 before it is cured in an embodiment where the first structure layer 30 is composed of a hardenable material. The balance segment 7 opposite the penetrating segment 5 has a generally flattened end 20 located in the second structure layer 34. The elongated body 12 can have an interior wall and an exterior wall. In various embodiments shown in FIG. 4 and FIG. 10, the elongated body 12 can have a first side face 13 and a second side face 15. Similarly, each end of the body 12 can be closed or open.

Alternatively, the balance segment 7 of the elongated body 12 can provide support for better coupling to the second structural layer 34. In one embodiment, the support structure can be a flange to better couple a structural layer of wood or metal. The flange can be configured to allow for better coupling to a wood or metal structure by having apertures for fasteners or similar welding points for a metal structure. In some embodiments, the connector 10 can be prefabricated with its own insulation layer in the mesial segment of the passage 17.

Figure 11:
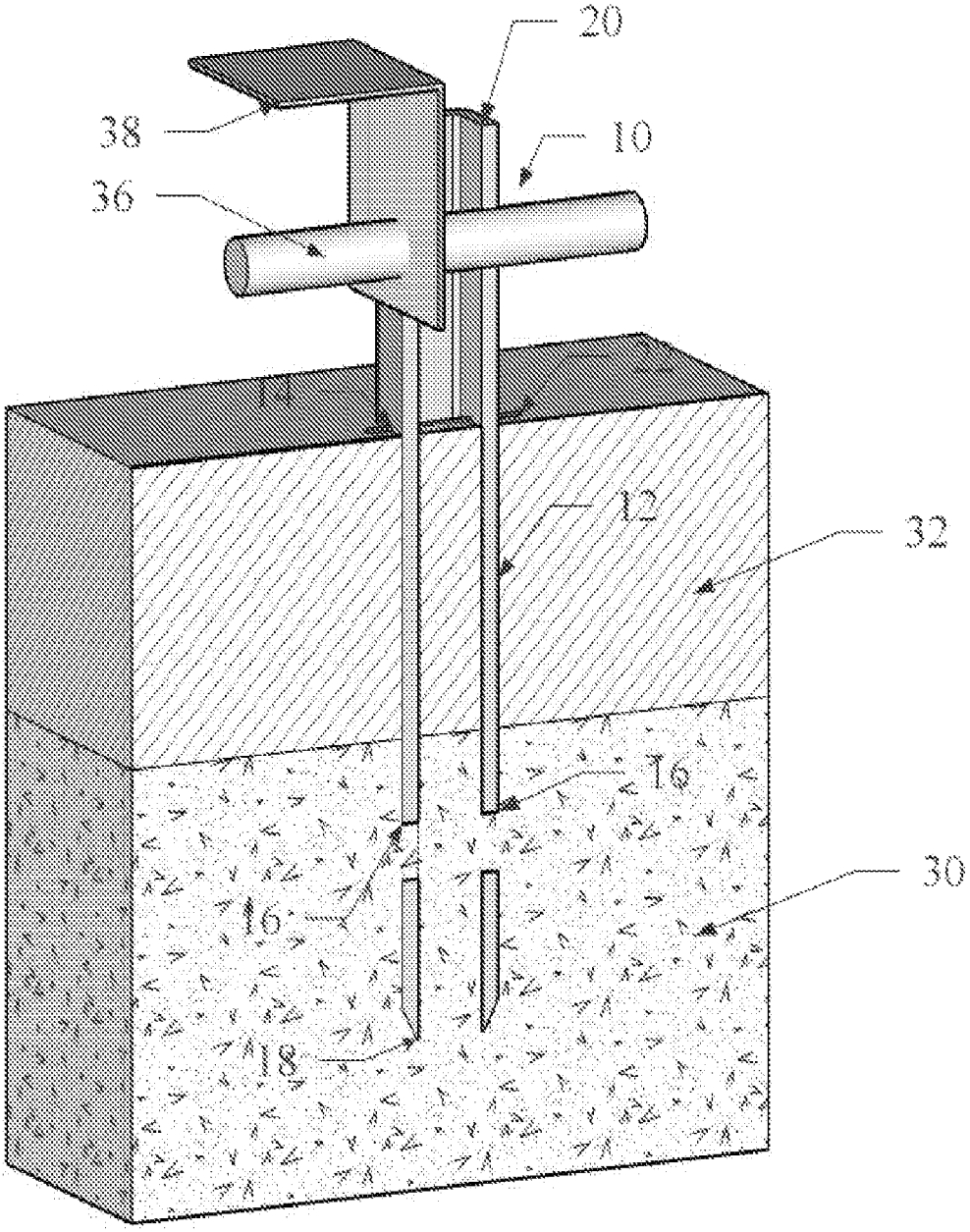
FIG. 11 is a perspective view of the connection between the tubular tie shear with a second structural layer made of steel.
Figure 12:
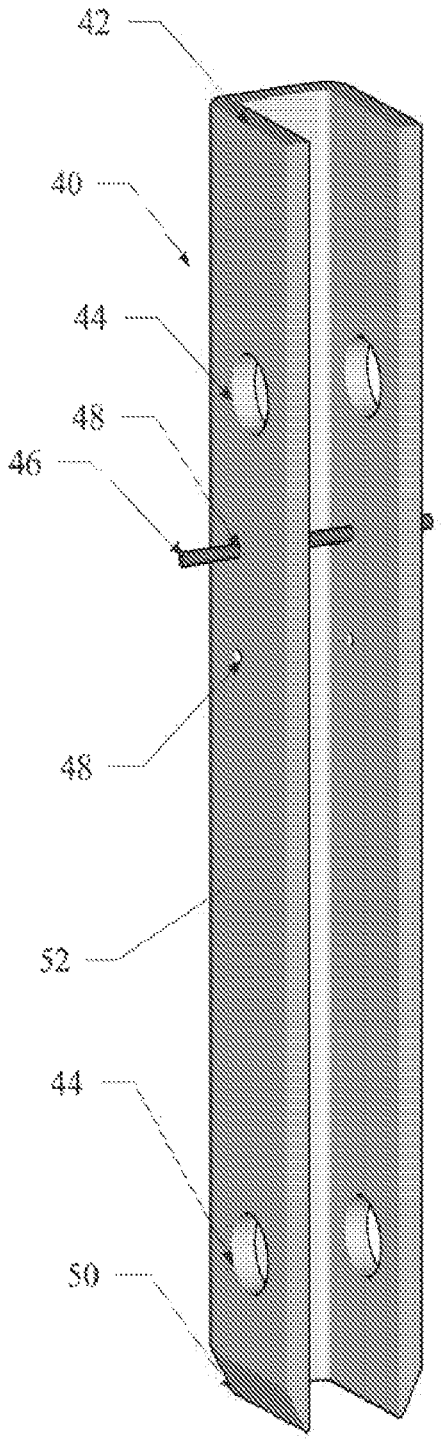
FIG. 12 is a perspective view of an exemplary embodiment of a partially closed-tubular tie connector of the present invention having a blade end at the penetrating segment.
Figure 13:
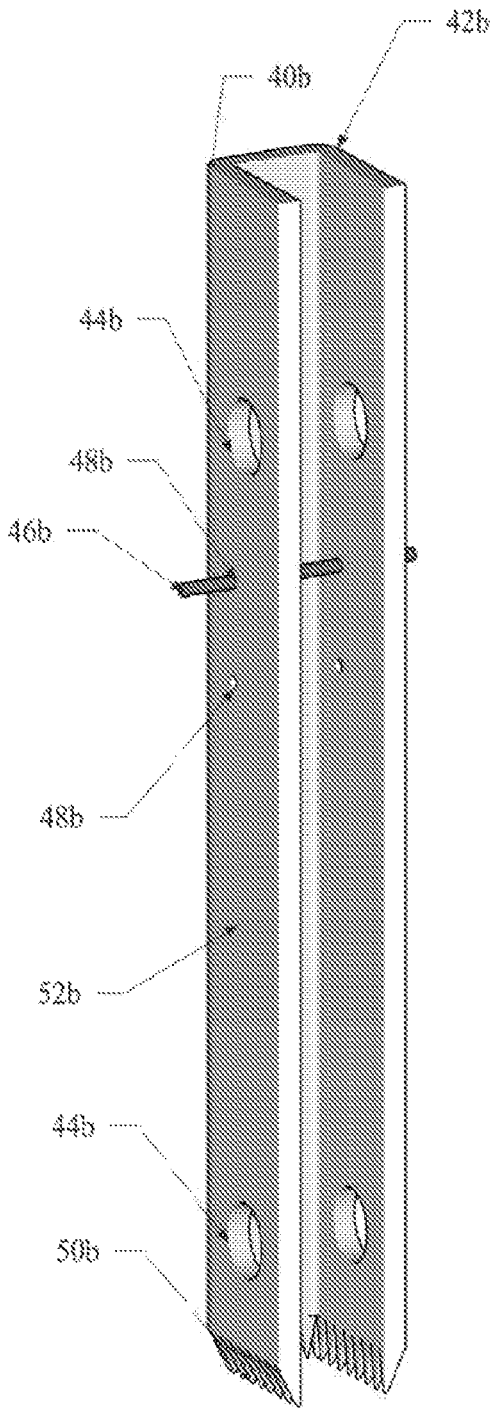
FIG. 13 is a perspective view of an exemplary embodiment of a partially closed-tubular tie connector of the present invention having a saw-tooth end at the penetrating segment.
Figure 14:
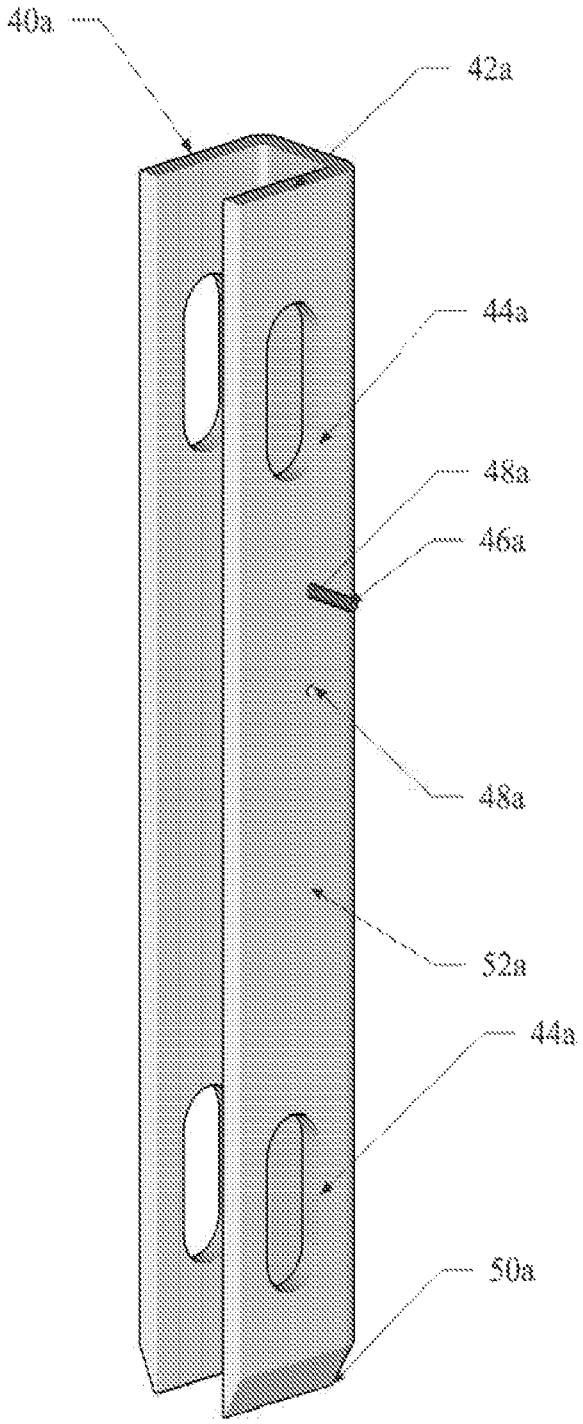
FIG. 14 is a perspective view of an exemplary embodiment of a partially closed-tubular tie connector of the present invention with larger apertures on the penetrating and balance segment.
Figure 15:
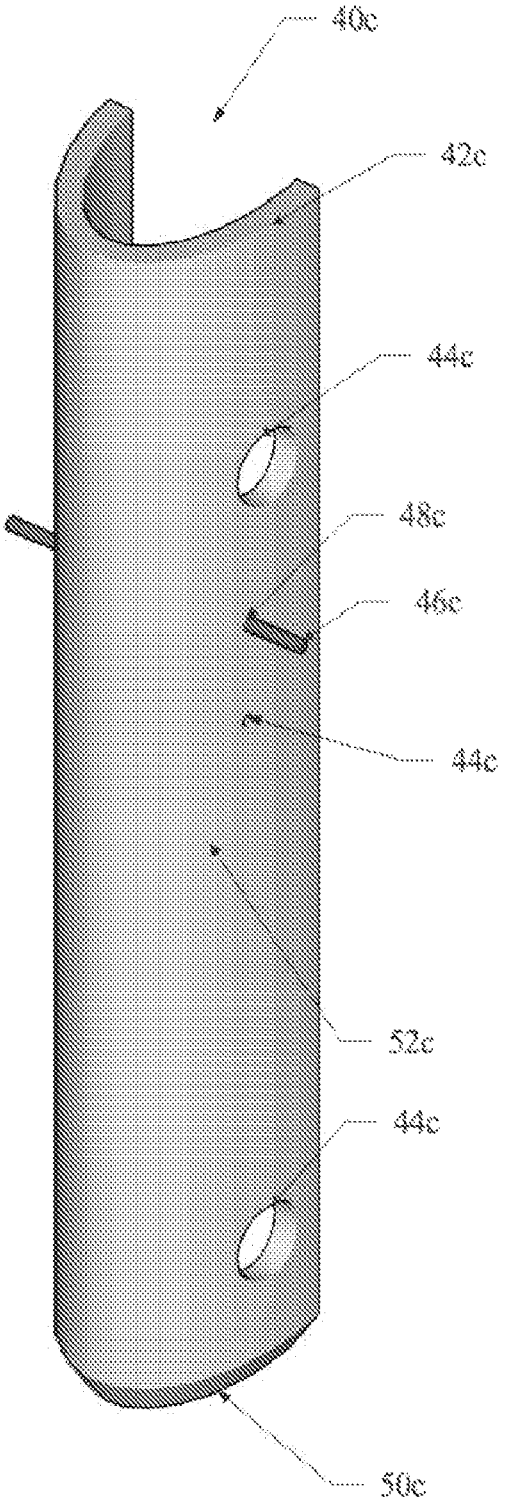
FIG. 15 is a perspective view of an exemplary embodiment of a partially closed-tubular tie connector of the present invention with a cross section of hollow aperture.
Figure 16:
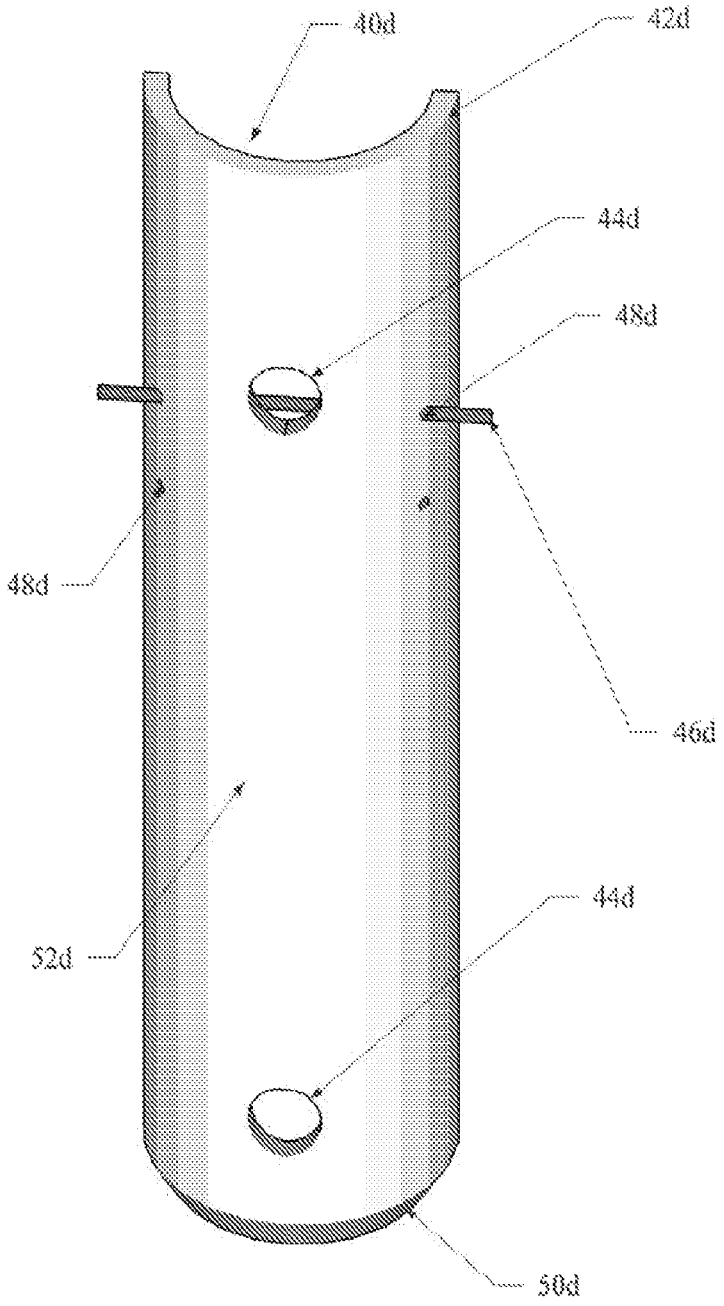
FIG. 16 is a perspective view of an exemplary embodiment of a partially closed-tubular tie connector of the present invention with a cross section of hollow ellipse of the present invention.

In one exemplary embodiment, the first structural layer 30 and the second structural layer 34 both can be comprised of a hardenable material. An elongated body 12 can have a plurality of apertures 16. The apertures 16 can take any shape, such as a circle or an elongated circular shape. In one embodiment, the apertures 16 can be symmetrically located in the penetrating segment 5. The apertures 16 enable a hardenable material to flow into the cavity 17 of the elongated body 12 and filling the apertures. Accordingly, after the hardenable material is hardened, the hardened material provides anchoring surfaces to ensure for good contacts to transfer forces between the first structural layer 30 and the connector 10. The elongated body 12 includes additional apertures 16 in the balance segment 7 and located in the second structural layer 34 to allow the hardenable material to also flow into the cavity 17 of the elongated body 12 and filling the apertures 16 and after it is hardened. Accordingly, the apertures 16 provide anchoring surfaces to ensure for good contacts to transfer forces between the second structural layer 34 and the connector 10. In another exemplary embodiment, when a second structure layer 34 is a steel or wooden frame structure, the apertures 16 can provide the space and means for fasteners 36, such as a bolt, or other connection fittings 38 to fix on the connector 10 as shown in FIG. 11

In one exemplary embodiment, the tie shear connector 10 can have a plurality of apertures 16 at a first end aligned with the penetrating segment 5 and a second end aligned with the balance segment 7 of the elongated body 12. The apertures can act as flow enabling means to allow for a fluidic hardenable material to enter the cavity/passage of the elongated body 12. The apertures 16 allow for a solid bond between the hardenable material and the tie shear connector 10, and provide the ability to transfer tension and compression forces along and parallel after the hardenable material has hardened.

The elongated body 12 can further comprise smaller apertures 14 at the intersection of the balance segment 7 and mesial segment 9 of the elongated body 12. In one exemplary embodiment, the elongated body 12 can have two layers of two pairs of smaller apertures 14 in the intersection of the balance segment and mesial segment of the elongated body 12. The two pairs of the smaller apertures 14 provide spaces for two placement pins 22 running perpendicularly through the body 12 and cavity 17 of the connector 10. The smaller apertures 14 can be located on both the first side face 13 and the second side face 15 to allow the placement pins 22 to run through the correlating smaller apertures 14 on each side. The two placement pins 22 can run through two opposite apertures of 14 at the same level and about against the insulation layer 32 surface to limit the penetration of the tubular tie shear connector 10 as indicated in FIG. 5. The two placement pins 22 can be used to lock the connector 10 in place after placement within the insulation layer 32 to position and maintain the connector 10 at the proper depth in the first structure layer 30. A second layer of small apertures 14*b* are provided for flexibility to allow the connector 10 to fit for different depths or thickness of the insulation board 32.

The placement pins 22 can be comprised of any suitable high R-value material, such as a polymer. The elongated body can have additional placement pin apertures to provide greater flexibility in the construction of insulated panel structures and allow for different insulated layers having different thicknesses. The placement pins 22 can ensure uniformity of the connectors positioned in an insulation layer 32. Depending on the thickness of the desired insulated panel 32 the placement pins 22 can be positioned in the appropriated placement pin apertures 14 to ensure an equal portion of the connector 10 protrudes on each side of the insulation layer 32. The placement pins 22 can run tangentially to the intersecting surface of the balance segment 7 and the mesial segment 9 and can lock the tie shear connector 10 in place after the placement within the insulation layer 32. The placement pins 22 can therefore regulate the depth of embedment within the first structure layer.

In another exemplary embodiment, the penetrating segment 5 is a saw-tooth end 18*a* for easily protruding the tubular tie shear connector 10*b*. The shape of the apertures 16 can be different or connected as the apertures 16*a* shown in the connector 10*a* of FIG. 3, as long as they are able to provide an opening to allow for the ability of a hardenable material to flow into the cavity 17 of the connector 10.

Figure 7:
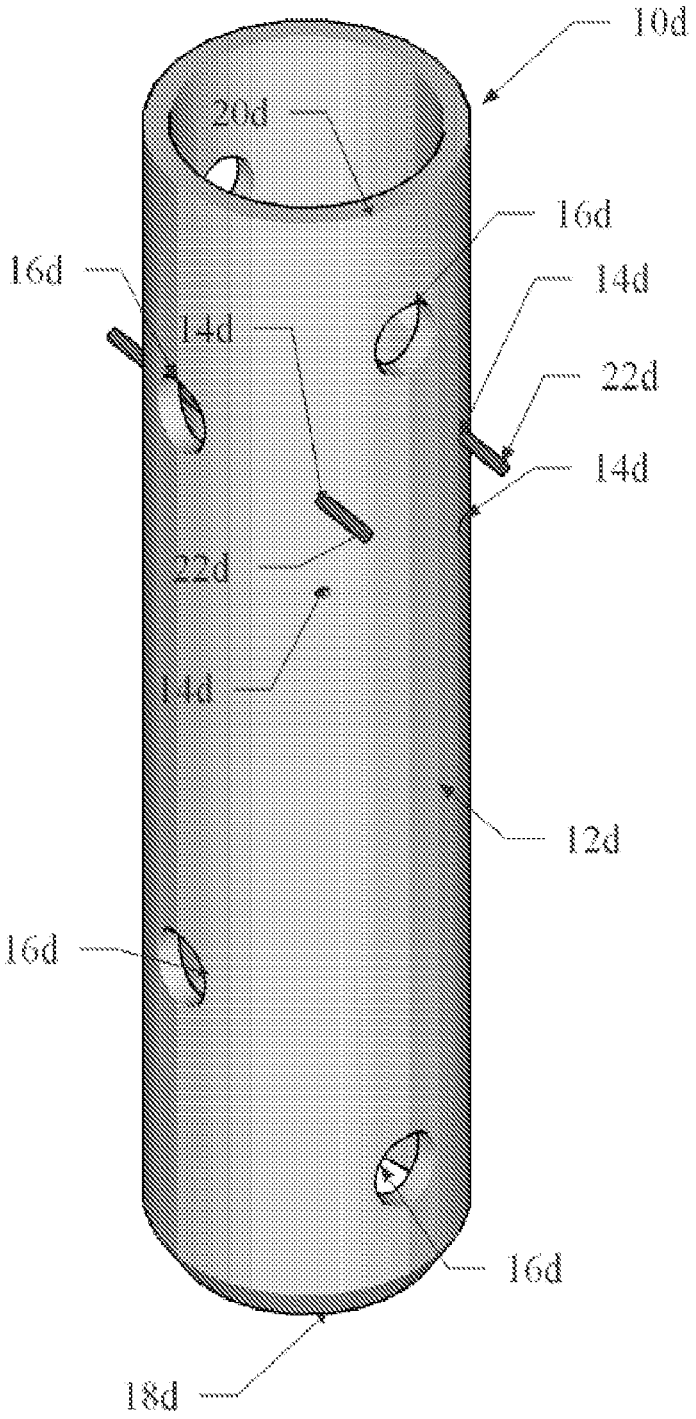
FIG. 7 is a perspective view of an exemplary embodiment of a tie shear connector with a cross section of a cylindrical hollow aperture.
Figure 8:
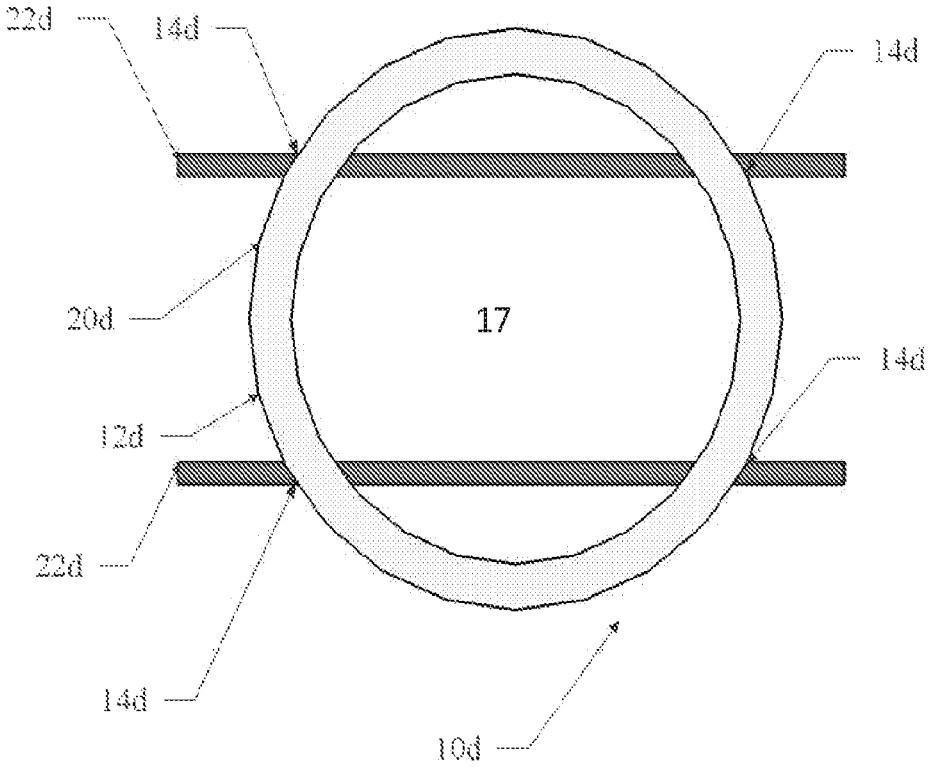
FIG. 8 is a sectional view taken from the top of the exemplary embodiment illustrated in FIG. 7.
Figure 9:
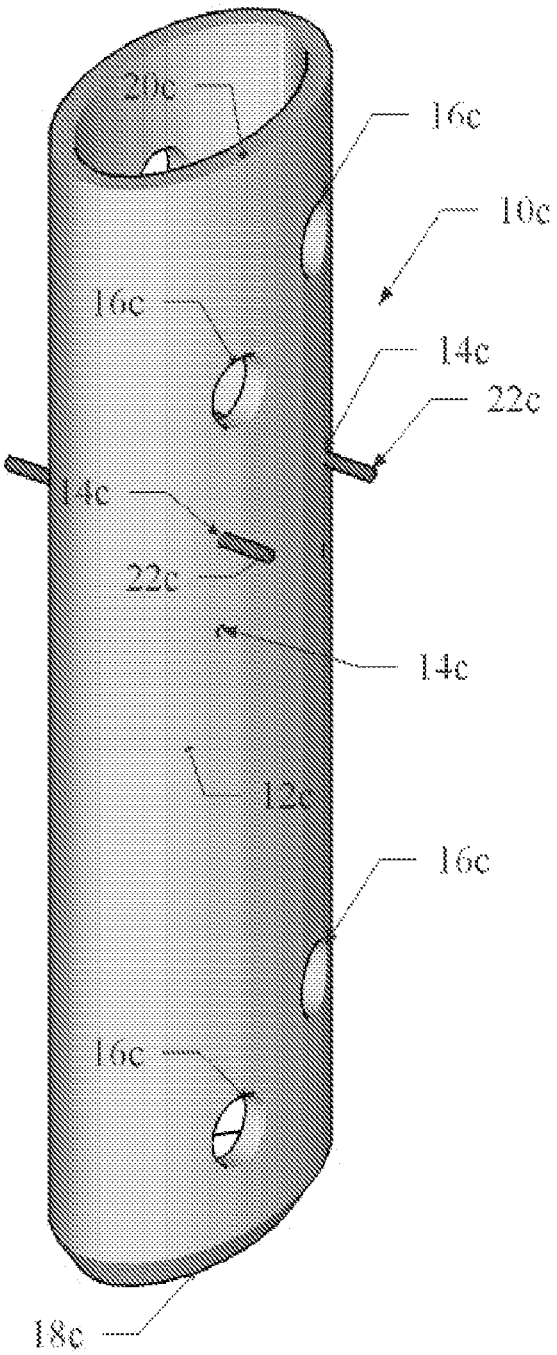
FIG. 9 is a perspective view of an exemplary embodiment of a tie shear connector with a cross section of a hollow ellipse of the present invention.
Figure 10:
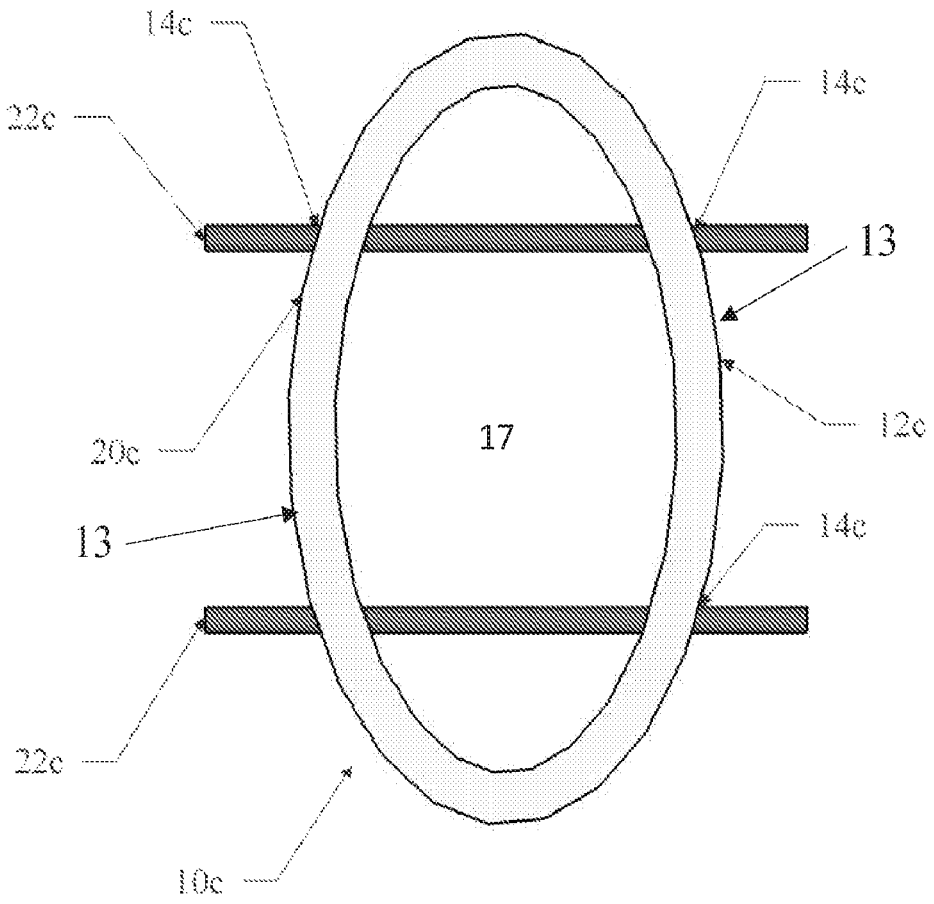
FIG. 10 is a sectional view taken from the top of the exemplary embodiment illustrated in FIG. 9.

FIGS. 7 and 9 show alternative embodiments of the connector with similar parts labeled with the same reference numerals and the suffix of c and d. FIG. 7 depicts a perspective view of a tubular tie shear connector 10*c* with a cross-section of a hollow circle forming a cylindrical shape. FIG. 9 depicts a perspective view of a tubular tie connector 10*d* with a cross section of a hollow ellipse.

In another aspect of the present invention, a method for manufacturing insulated composite wall structures is provided using the tie shear connector 10 of the present invention. The tie shear connector 10 can first be driven through an insulation layer or panel using the blade end 18, 18*a* or saw tooth end 18*b* of the tie shear connector 10*b*. Alternatively, the insulation layer 32 can have pre-determined and pre-bored holes configured to accept individual tie shear connectors 10.

A first layer of a first hardenable material 30 can be poured. The insulation layer 32 having the tie shear connectors 10 preinstalled can then be placed on the first layer of hardenable material 30 prior to the hardenable material 30 hardening. Alternately, the tie shear connectors 10 can be inserted through the insulation layer 32 using the blade end 18 of the elongated body to penetrate the insulation layer and enter to the first layer of hardenable material 30. The insulation layer is placed in a manner such that the first surface of the insulation layer is in contact with the first layer of the hardenable material 30 and a portion of the tie shear connector 10 is embedded in the first hardenable material. The hardenable material 30 will then enter a portion of the cavity 17 through the aperture 16 or plurality of apertures 16.

A second layer of a hardenable material 34 can then be poured over the second surface of the insulation layer 32, such that the second surface of the insulation layer is in contact with the second layer of the hardenable material 34. A portion of the tie shear connector 10 is embedded in the second hardenable material 34 and the hardenable material is able to enter a portion of the cavity 17 through the aperture 16 or apertures 16 of the tie shear connector 10. The ability for the hardenable material of the first and second layers of hardenable material to flow into the cavity 17 through the apertures 16 forms a cross bridge between the first layer of hardenable material 30 and the second layer of hardenable material 34 with an insulation layer 32 located in between. This cross bridge formed by the tie shear connector 10 and cavity 17 is configured to transfer shear forces and resist delamination forces between said first 30 and second layers 34 of hardenable material.

The tie shear connector 10 can further comprise additional apertures 14 configured to accept placement pins 22 for limiting penetration of the tie shear connector 10 through the insulation layer 32. This can ensure that a uniform penetration depth is achieved consistently when penetrating the insulation layer 32 or positioning the tie shear connectors 10 in pre-bored holes of the insulation layer 32. The placement pin apertures 14 can be smaller in nature than the apertures 16 configured to allow the flow of hardenable material.

Figure 6A:
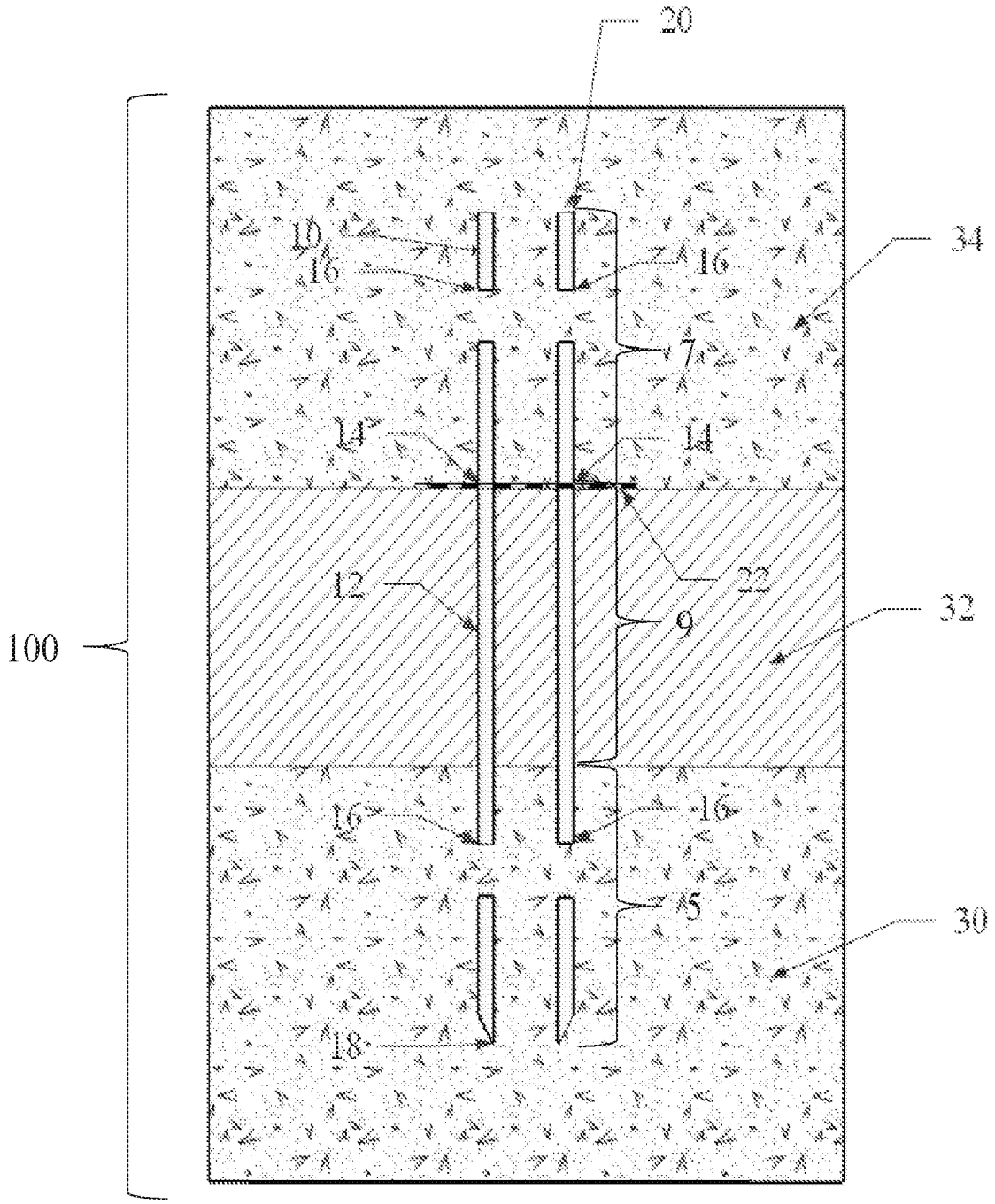
FIG. 6A is a cross-sectional view taken along the width direction and cutting through the apertures of the exemplary embodiment illustrated in FIG. 1.
Figure 6B:
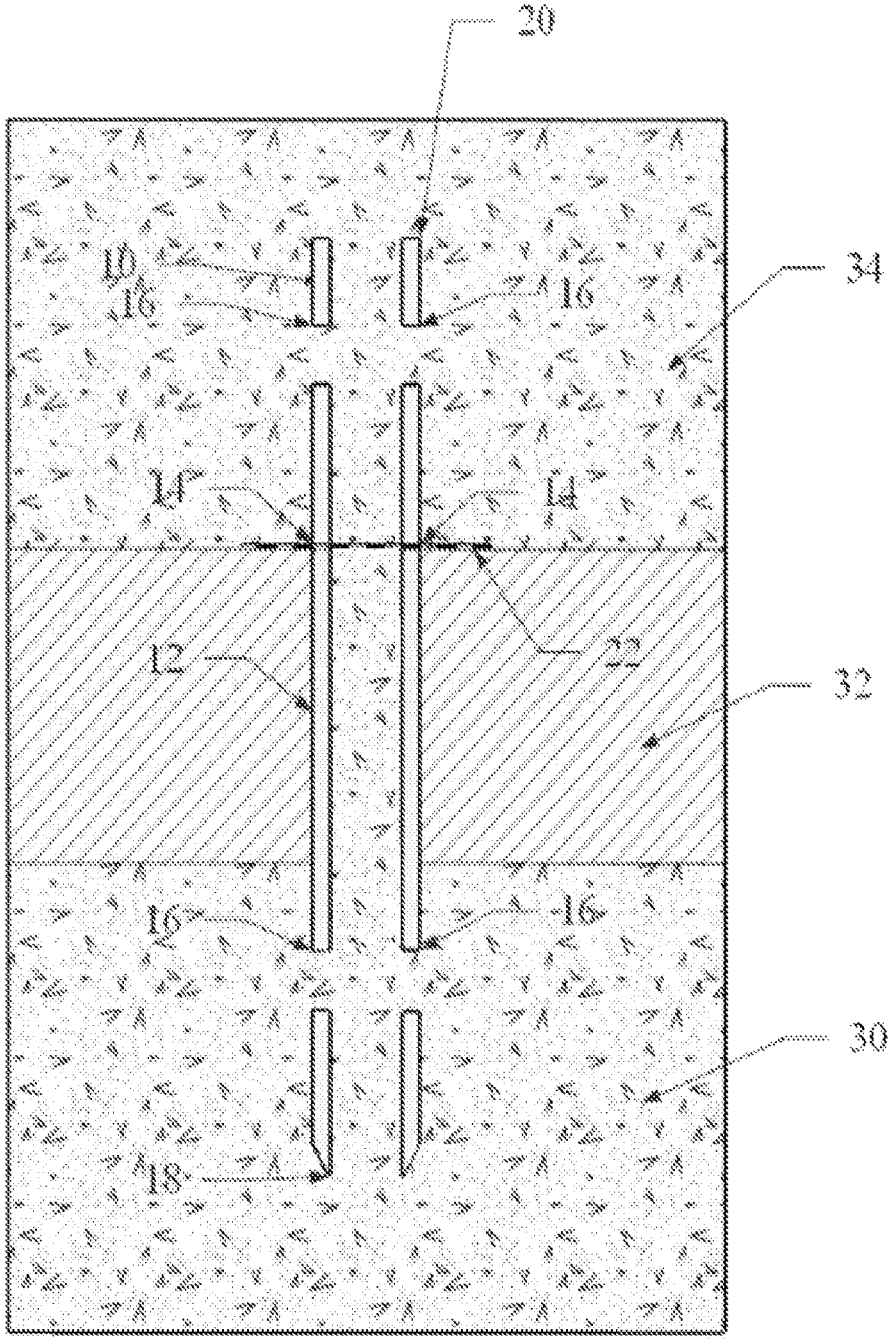
FIG. 6B is a cross-sectional view taken along the width direction and cutting through the apertures of the exemplary embodiment illustrated in FIG. 1 where the hardenable material has penetrated the entire passage of the tie shear connector.

FIG. 5 and FIG. 6A-B illustrate an exemplary embodiment of an insulated panel structure produced using the tie shear connectors 10. The first 30 and second 34 structural layer can be composed of a hardenable material that can enter the passage 17 of the elongated body 12. FIG. 6A illustrates an exemplary embodiment of an insulating panel structure using a tie shear connector 10 of the present invention. In this embodiment, a portion of the insulation layer 32 can be maintained in the mesial portion 9 of the connector 10. Both the first 30 and second 34 hardenable material of the first 30 and second 34 structure layer occupies portions of the cavity 17 of the connector 10. FIG. 6B illustrates another exemplary embodiment of an insulating panel structure where the cavity 17 of the connector 10 has been completely filled with hardenable material further bridging the first structure layer and the second structure layer.

In another exemplary embodiment, a partially closed-tubular tie shear connector 40, 40*a*,40*b*,40*c*, and 40*d* as shown in FIGS. 12-16 can be used to maintain the integrity of the insulation form and correspond to the tubular connectors 10, 10*a*, 10*b*,10*c*,10*d*, respectively. Therefore, once the tie shear connectors penetrate the insulation foam, the foam will not be cut into many small pieces although the placement pins can keep the cut pieces stay in their original position. The configurations of the half or partially closed tubular tie shear connectors are similar to the complete tubular tie shear connectors except there is no-closed enclosure. Corresponding, the partially closed-tubular tie shear connectors have the apertures 44, 44*a*,44*b*,44*c*,44*d*; the placement pins 46, 46*a*,46*b*,46*c*,46*d*; smaller apertures for placement pins 48,48*a*,48*b*,48*c*,48*d*; flat end 42, 42*a*,42*b*, 42*c*,42*d*; and penetration end 50, 50*a*,50*b*,50*c*,50*d*. The functions for those components in the partially closed tubular tie connectors are the same as illustrated for the tubular tie connector 10.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the appended claims.

What is claimed is:

1. A method of constructing insulating composite wall structures comprising:

providing an insulation panel layer, wherein said insulation layer has a first surface and a second surface;

pouring a first layer of a first hardenable material;

placing the first surface of the insulation layer on the first layer of the first hardenable material prior to the hardenable material hardening, such that the first surface of the insulation layer is in contact with the first layer of the hardenable material;

inserting tie shear connectors, wherein said tie shear connectors comprise an elongated body with a cavity running therethrough; at least one aperture configured to provide access into a cavity;

pouring a second layer of a second hardenable material over the second surface of the insulation layer, such that the second surface of the insulation layer is in contact with the second layer of the hardenable material, wherein a portion of the tie shear connector is embedded in the second hardenable material and said hardenable material enters a portion of the cavity through a second aperture;

wherein said tie shear connectors and said cavity of said tie shear connectors are configured to transfer shear forces and resist delamination forces between said first and second layers of hardenable material; and wherein the tie shear connectors further comprises a plurality of removable and adjustable placement pins, wherein the plurality of removable and adjustable placement pins are configured to prevent the tie shear connectors from passing completely through the insulation panel layer.

2. The method of claim 1, wherein said first hardenable material and said second hardenable material are the same.

3. The method of claim 1, wherein said first hardenable material and second hardenable material is concrete.

4. The method of claim 1, wherein said first hardenable material is concrete and second hardenable material is a polymer.

5. The method of claim 1, further comprising the steps of positioning the tie shear connector within the insulation panel layer using said placement pins to determine the depth of penetration.

* * * * *